US008252075B2

(12) United States Patent
Zuyev et al.

(10) Patent No.: US 8,252,075 B2
(45) Date of Patent: Aug. 28, 2012

(54) BONDED ABRASIVE TOOL AND METHOD OF FORMING

(75) Inventors: Konstantin S. Zuyev, Grafton, MA (US); Walter Strandgaard, Holden, MA (US); Joel A. Fife, Worcester, MA (US); Muthu Jeevanantham, Worcester, MA (US)

(73) Assignees: Saint-Gobain Abrasives, Inc., Worcester, MA (US); Saint-Goabain Abrasifs, Conglans-Sainte-Honorine (FR)

( * ) Notice: Subject to any disclaimer, the term of this patent is extended or adjusted under 35 U.S.C. 154(b) by 106 days.

(21) Appl. No.: 12/645,275

(22) Filed: Dec. 22, 2009

(65) Prior Publication Data

US 2010/0162632 A1 Jul. 1, 2010

Related U.S. Application Data

(60) Provisional application No. 61/141,592, filed on Dec. 30, 2008.

(51) Int. Cl.
*C09K 3/14* (2006.01)

(52) U.S. Cl. ..... 51/298; 51/299

(58) Field of Classification Search ..... 51/298, 51/299

See application file for complete search history.

(56) References Cited

U.S. PATENT DOCUMENTS

| | | | | |
|---|---|---|---|---|
| 3,098,730 | A * | 7/1963 | Rowse | 51/298 |
| 3,524,286 | A | 8/1970 | Wohrer | |
| 4,115,077 | A | 9/1978 | Fukuda | |
| 4,226,602 | A | 10/1980 | Fukuda | |
| 4,615,946 | A * | 10/1986 | Temple | 428/361 |
| 4,918,874 | A | 4/1990 | Tiefenbach, Jr. | |
| 5,037,453 | A | 8/1991 | Narayanan et al. | |
| 5,129,919 | A | 7/1992 | Kalinowski et al. | |
| 5,525,180 | A * | 6/1996 | Paul et al. | 156/250 |
| 6,609,963 | B2 | 8/2003 | Li et al. | |
| 6,881,483 | B2 | 4/2005 | McArdle et al. | |
| 2003/0194947 | A1 * | 10/2003 | Bright et al. | 451/28 |
| 2007/0010175 | A1 | 1/2007 | Feng et al. | |
| 2007/0059506 | A1 * | 3/2007 | Hager et al. | 428/292.1 |
| 2007/0060001 | A1 * | 3/2007 | Patel et al. | 442/76 |
| 2007/0074456 | A1 * | 4/2007 | Orlhac et al. | 51/307 |
| 2008/0072500 | A1 | 3/2008 | Klett et al. | |
| 2008/0160281 | A1 * | 7/2008 | Vickery et al. | 428/295.1 |
| 2008/0305329 | A1 * | 12/2008 | D'Silva et al. | 428/372 |

FOREIGN PATENT DOCUMENTS

JP 2004190201 A * 7/2004

* cited by examiner

*Primary Examiner* — Jessica L Ward
*Assistant Examiner* — Ross J Christie
(74) *Attorney, Agent, or Firm* — Abel Law Group, LLP; Joseph P. Sullivan

(57) ABSTRACT

A bonded abrasive tool includes a bonded abrasive body having a bond matrix material comprising an organic bond material, abrasive grains contained within the bond matrix material, and not greater than about 5 vol % chopped fiber bundles within the bond matrix material. The tool further has a porosity within the bonded abrasive body, wherein a majority of the porosity comprises pores surrounding the chopped fiber bundles.

14 Claims, 4 Drawing Sheets

BONDED ABRASIVE TOOL AND METHOD OF FORMING

CROSS-REFERENCE TO RELATED APPLICATION(S)

Figure 1:
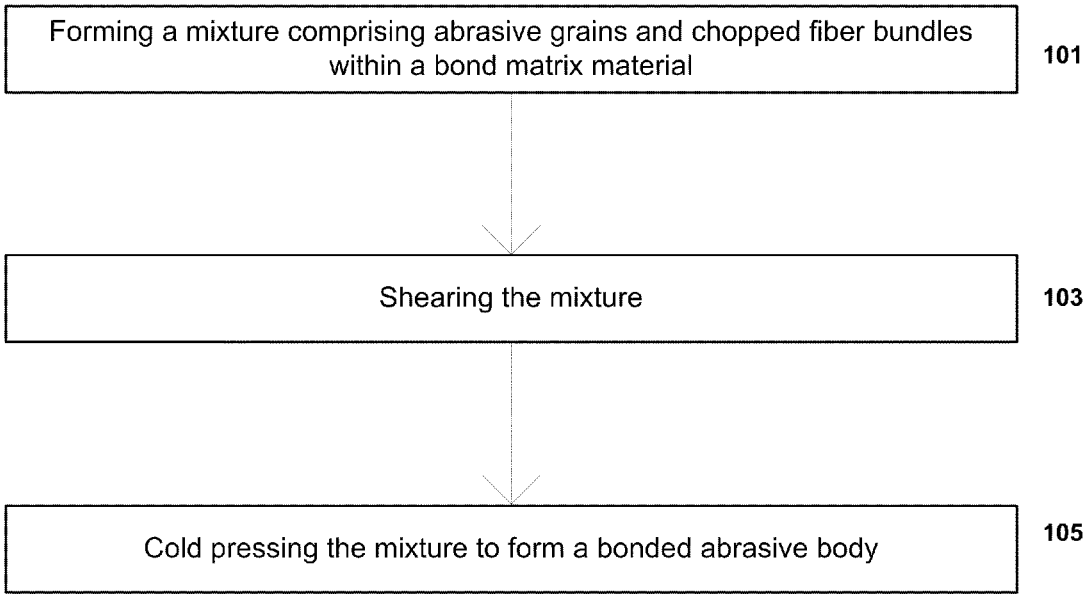

The present application claims priority from U.S. Provisional Patent Application No. 61/141,592, filed Dec. 30, 2008, entitled "Bonded Abrasive Tool and Method of Forming," naming inventors Konstantin S. Zuyev, Walter Strandgaard, Joel A. Fife and Muthu Jeevanantham, which application is incorporated by reference herein in its entirety.

BACKGROUND

1. Field of the Disclosure

The following is directed bonded abrasive tools, and in particular, bonded abrasive tools incorporating an organic bond material and having particular microstructure.

2. Description of the Related Art

Abrasives used in machining applications typically include bonded abrasive articles and coated abrasive articles. Coated abrasive articles generally include a layered article including a backing and an adhesive coat to fix abrasive grains to the backing, the most common example of which is sandpaper. Bonded abrasive tools consist of rigid, and typically monolithic, three-dimensional, abrasive composites in the form of wheels, discs, segments, mounted points, hones and other tool shapes, which can be mounted onto a machining apparatus, such as a grinding or polishing apparatus. Such bonded abrasive tools usually have three phases including abrasive grains, bond material, and porosity, and can be manufactured in a variety of 'grades' and 'structures' that have been defined according to practice in the art by the relative hardness and density of the abrasive composite (grade) and by the volume percentage of abrasive grain and bond within the composite (structure).

Bonded abrasive tools are particularly useful in grinding and polishing various materials including single crystal materials, ceramic surfaces, and metals or metal alloys. In particular instances, bonded abrasive tools having organic bond materials, such as a resinous bond material, are used for grinding metal surfaces. However, grinding and polishing of such materials can be an aggressive process resulting in significant wear on the bonded abrasive tool, thus limiting the lifetime of the tool. Accordingly, a need exists in the art for methods and articles for effective grinding and polishing of materials.

SUMMARY

According to a first aspect a bonded abrasive tool includes a bonded abrasive body including a bond matrix material made of an organic bond material, abrasive grains contained within the bond matrix material, and chopped fiber bundles within the bond matrix material. The tool further includes porosity within the bonded abrasive body, wherein a majority of the porosity comprises pores surrounding the chopped fiber bundles.

According to another aspect, a bonded abrasive tool includes a bonded abrasive body having a bond matrix material made of an organic bond material, abrasive grains contained within the bond matrix material, and chopped fiber bundles within the bond matrix. The tool further includes porosity within the bonded abrasive body, wherein the porosity comprises two phases, a first phase comprising small pores uniformly dispersed within the bond matrix material, and a second phase comprising large pores selectively disposed around the chopped fiber bundles.

According to a third aspect, a bonded abrasive tool includes a bonded abrasive body having a bond matrix material made of an organic bond material, abrasive grains contained within the bond matrix material, and chopped fiber bundles within the bond matrix comprising a length (l), a width (w), and an aspect ratio (l:w) defined by the length and the width of at least about 2:1. The tool further includes porosity within the bonded abrasive body, wherein a majority of the porosity comprises pores surrounding the chopped fiber bundles.

In another aspect, a bonded abrasive tool includes a bonded abrasive body having a bond matrix material comprising an organic bond material, abrasive grains contained within the bond matrix material, and chopped fiber bundles within the bond matrix having a length within a range between about 1 mm and about 5 mm. The tool further includes porosity within the bonded abrasive body, wherein the porosity comprises two phases, a first phase comprising small pores having circular cross-sectional shapes uniformly dispersed within the bond matrix material, and a second phase comprising large pores extending laterally around portions of the peripheral surfaces of the chopped fiber bundles.

According to one aspect, a bonded abrasive tool includes a bonded abrasive body having a bond matrix material made of an organic bond material, abrasive grains contained within the bond matrix material, and chopped fiber bundles within the bond matrix. The tool further includes porosity within the bonded abrasive body, wherein a majority of the porosity comprises pores surrounding the chopped fiber bundles, wherein the bonded abrasive body comprises a fracture toughness of at least about 750 $J/mm^2$.

In accordance with another aspect, a bonded abrasive tool includes a bonded abrasive body having a bond matrix material made of an organic bond material, abrasive grains contained within the bond matrix material, and chopped fiber bundles within the bond matrix. The tool further includes porosity within the bonded abrasive body, wherein the porosity comprises two phases, a first phase comprising small pores uniformly dispersed within the bond matrix material, and a second phase comprising large pores surrounding the chopped fiber bundles, the bonded abrasive body demonstrating a material removal rate (MMR) of at least about 13 $in^3$/min and having a G-ratio (MMR/WWR) of not greater than about 40 while grinding a metal workpiece having a thickness of 0.5 inches with a downforce applied to the bonded abrasive body of at least about 45 HP.

In another aspect, a method of forming a bonded abrasive product includes the steps of, (a) forming a mixture comprising abrasive grains contained within a bond matrix material and chopped fiber bundles within the bond matrix material, the bond matrix material comprising an organic bond material, and (b) shearing the mixture. The method further includes (c) cold pressing the mixture at a temperature of not greater than about 30° C. to form a bonded abrasive body having porosity, wherein a majority of the porosity comprises large pores surrounding the chopped fiber bundles.

DETAILED DRAWINGS

The present disclosure may be better understood, and its numerous features and advantages made apparent to those skilled in the art by referencing the accompanying drawings.

FIG. 1 includes a flow chart for forming a bonded abrasive tool in accordance with an embodiment.

Figure 2:
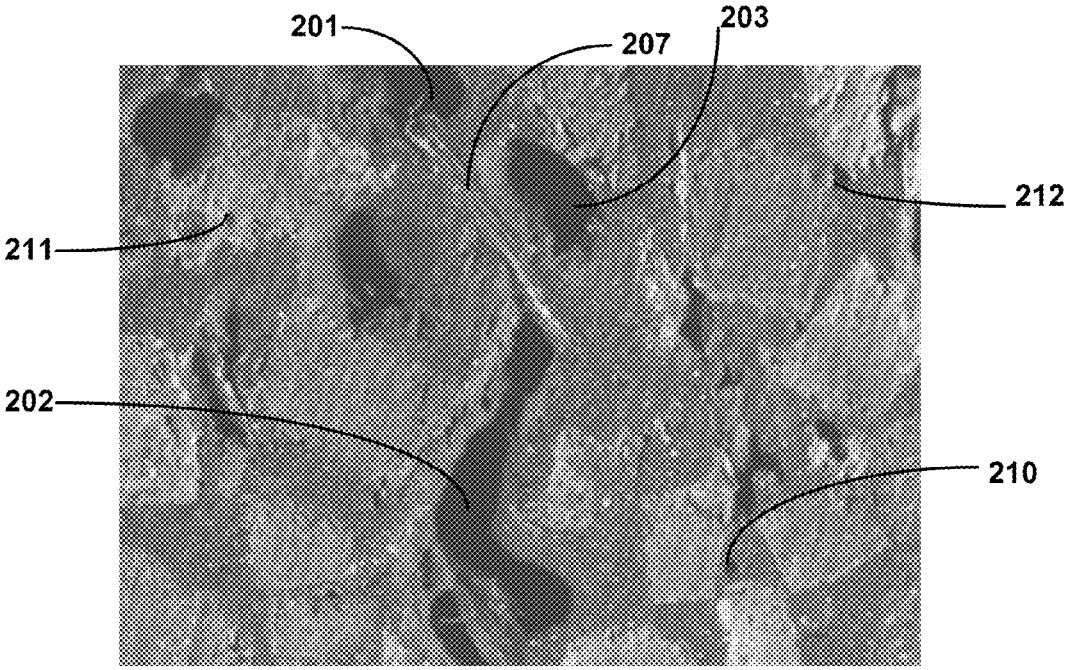

FIG. 2 includes an image in cross-section of a portion of the bonded abrasive body in accordance with an embodiment.

Figure 3:
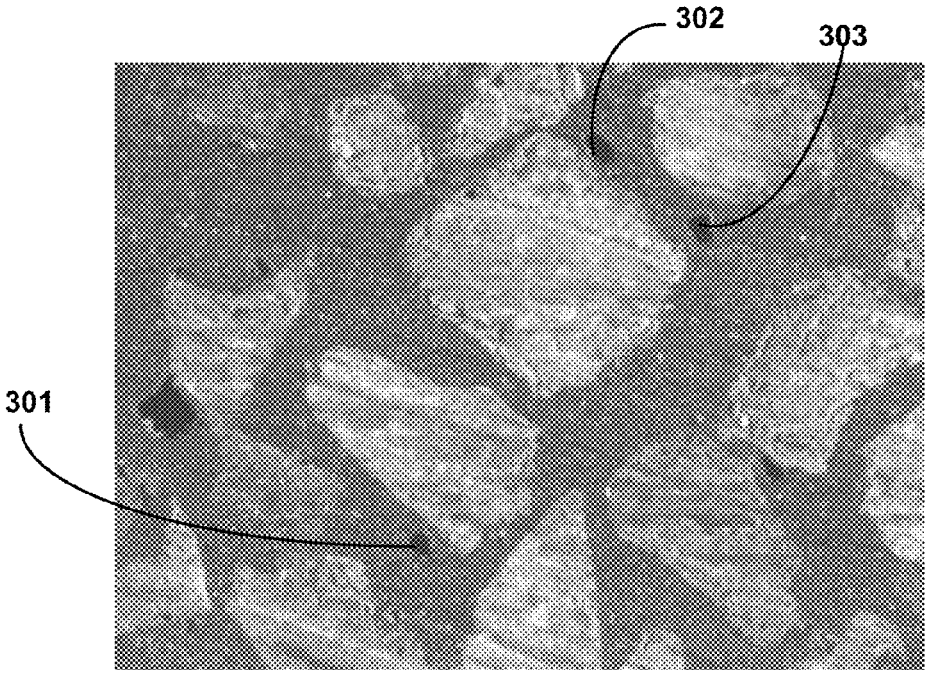
Prior Art FIG. 3

FIG. 3 includes an image in cross-section of a portion of a prior art bonded abrasive body formed according to a conventional process.

Figure 4:
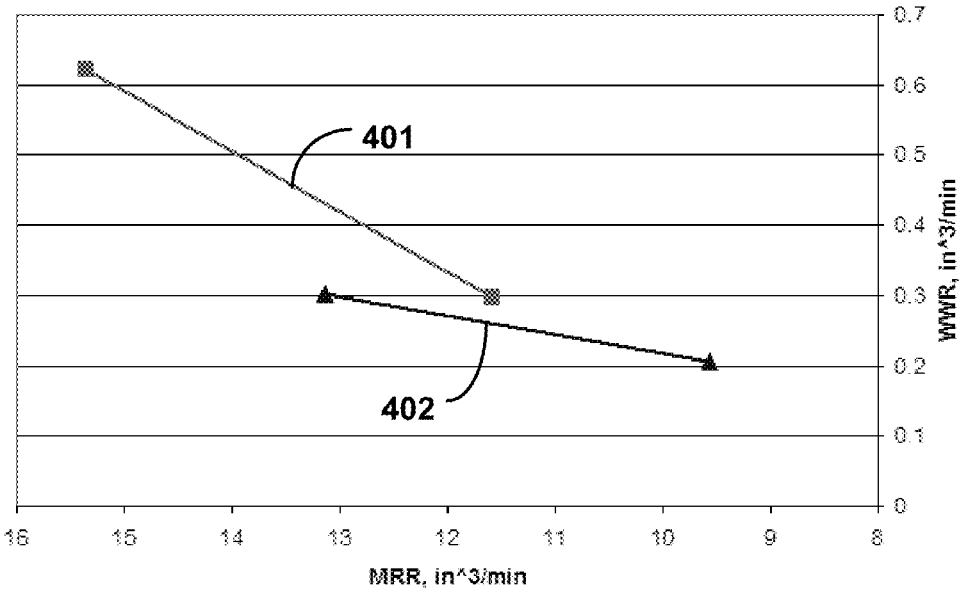

FIG. 4 includes a graph of wheel wear rate versus material removal rate for two samples, one sample formed in a conventional manner, a second sample formed in accordance with an embodiment.

Figure 5:
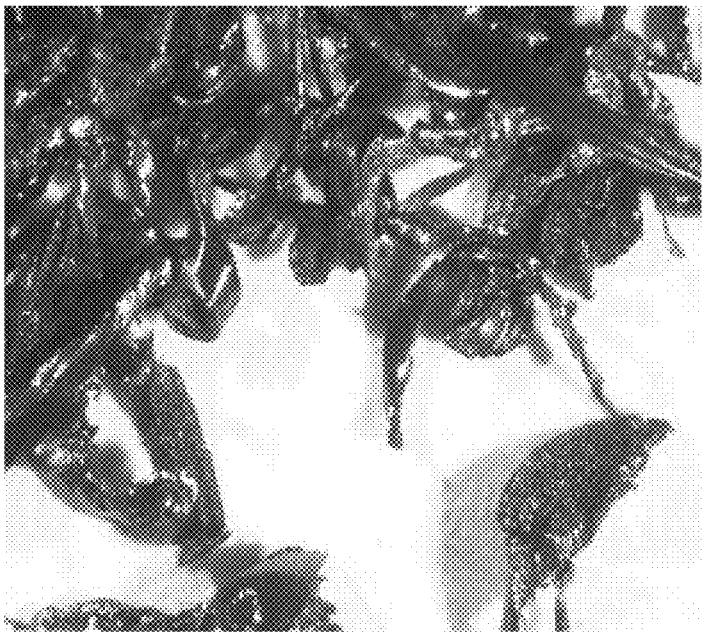
Prior Art FIG. 5

FIG. 5 includes an image of metal chips removed from a workpiece that was ground using a prior art bonded abrasive body.

Figure 6:
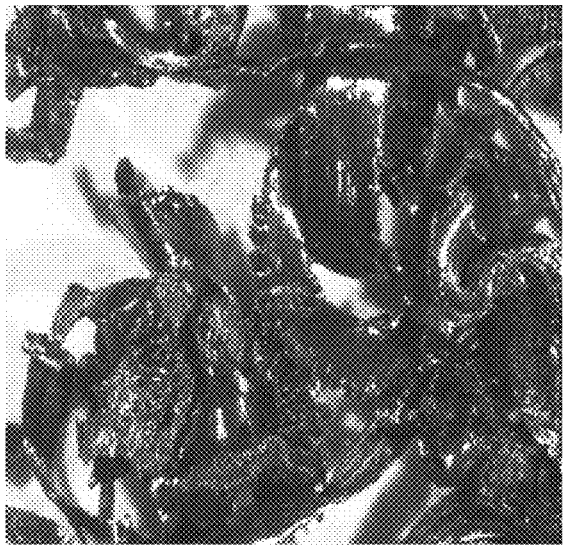

FIG. 6 includes an image of metal chips removed from a workpiece that was ground using a bonded abrasive body formed in accordance with an embodiment.

Figure 7:
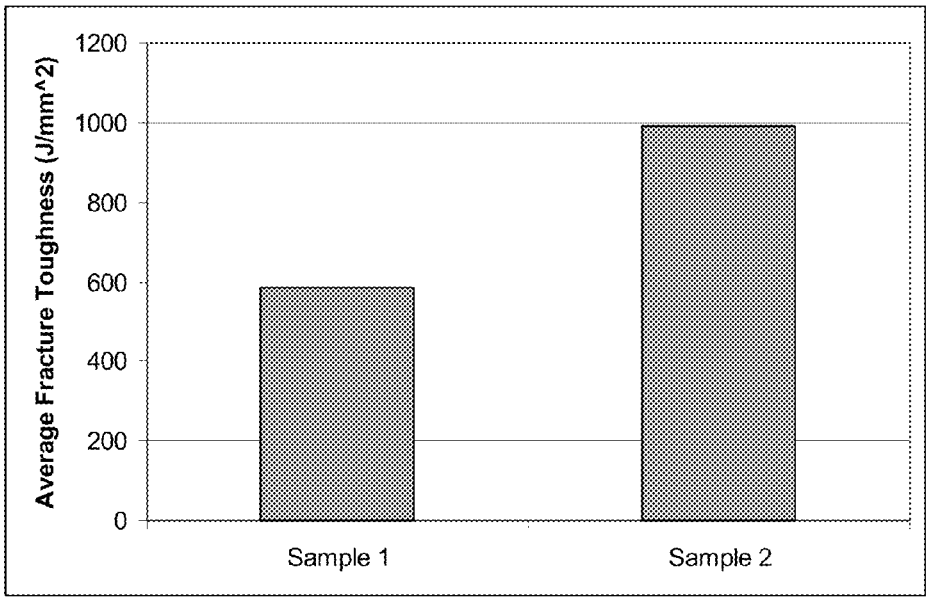

FIG. 7 includes a graph of fracture toughness for a sample formed according to a conventional process and a sample formed according to an embodiment.

The use of the same reference symbols in different drawings indicates similar or identical items.

DESCRIPTION OF THE PREFERRED EMBODIMENT(S)

The following is directed to bonded abrasive tools which typically includes abrasive grains contained within a three-dimensional matrix of bonding material. In particular, the bonded abrasive tools herein can take a variety of shapes such as wheels, hones, cones, and the like. Such tools are suitable for grinding and finishing of workpieces such as metal workpieces.

FIG. 1 includes a flow chart illustrating a method of forming a bonded abrasive tool in accordance with an embodiment. In particular, the process of forming the bonded abrasive tool is initiated at step 101 by forming a mixture comprising abrasive grains and chopped fiber bundles within a bond matrix material. Embodiments herein are directed to bonded abrasive tools that use an organic bond matrix material. Organic bond material suitable for use in the bond matrix material can include polymers such as thermoplastic resins, thermoset resins, rubbers, and a combination thereof. In more particular instances, epoxies, polyesters, phenolics, cyanate esters, and a combination thereof may be used. Certain embodiments utilize an organic bond material that consist essentially of phenolic resin.

Generally, a suitable amount of bond matrix material used within the mixture is on the order of at least 20 vol %. In accordance with some embodiments, the mixture may contain a higher content of bond matrix material, such as at least about 25 vol %, at least about 30 vol %, at least 35 vol %, or even about 45 vol %. Particular embodiments utilize a content of bond matrix material within a range between about 20 vol % and about 60 vol %.

Filler material, or "active filler" material may be included within the bond matrix material to achieve various benefits during grinding and finishing using the bonded abrasive tool. For example, some fillers can act as lubricants. Metal salts, oxides, and halides are particularly suitable filler material compounds. Such compounds can include elements such as manganese, silver, boron, phosphorous, copper, iron, zinc, calcium, and a combination thereof. Generally, fillers make up a small percentage of the total volume of material within the mixture.

As described herein, the mixture may contain a certain content of abrasive grains to facilitate machining and/or grinding processes in accordance with the intended application of the bonded abrasive tool. Accordingly, the abrasive grains are a hard materials, typically having a Mohs hardness of at least about 7. In other instances, the hardness of the abrasive grains may be greater, such as at least about 8, 9, or even 10 on the Mohs hardness scale.

Suitable abrasive grains can be made of oxides, carbides, borides, nitrides, and a combination thereof. In accordance with one particular embodiment, the abrasive grains consist essentially of alumina. In other bonded abrasive bodies, the abrasive grains may include superabrasive materials. Superabrasive materials generally include diamond (natural or synthetic), silicon carbide, and cubic boron nitride.

The bonded abrasive tools herein generally include coarse abrasive grains for grinding of metal workpieces. The bonded abrasive tools typically incorporate abrasive grains having an average particle size of at least about 0.25 mm. Certain tools may utilize larger abrasive grains, such that the average particle size is at least about 0.5 mm, such as at least about 1 millimeter, or even at least about 2 mm. In particular instances, the average particle size of the abrasive grains is within a range between about 0.5 mm and about 7 mm, and more particularly within a range between about 2 mm and 5 mm.

The mixture can have an abrasive grain content of at least 30 vol %. In some mixtures, the content of abrasive grains may be greater, such that it is at least about 40 vol %, at least about 50 vol %, or even at least about 55 vol %. In particular embodiments, the mixture includes between about 30 vol % and 60 vol % abrasive grains.

The formation of the mixture may also include the addition of other additives. Some suitable additives can include pore-forming materials. Based on the processes used herein, the pore-formers are generally liquid materials. In particular, the liquid pore-formers can be organic materials having low volatilization temperatures. In accordance with one embodiment, an organic liquid, such as formaldehyde, is added to the mixture such that during processing, some porosity is formed within the tool body upon volatilization of the formaldehyde. Additionally, it will be appreciated that during processing, the mixture may obtain some natural pores (e.g., trapped bubbles within the mixture) that are transferred to the final-formed body as natural porosity.

The mixture generally contains minor amounts of such liquid pore-forming materials. For example, the mixture can include not greater than about 5 vol % of such liquid additives. In particular instances, the mixture includes between about 2 vol % and about 4 vol % of such additives.

The foregoing has made reference to a mixture made of bond matrix material, abrasive grains, and other additives. In accordance with a particular embodiment, formation of the mixture as described in step 101 may first include formation of a single mixture containing the abrasive grains, bond matrix material, and any additives. After such a mixture is suitably formed, chopped fiber bundles may be added to the mixture containing the bond matrix material and abrasive grains. Chopped fiber bundles are a composite material containing a first material in the form of a series of fibers bonded together with a second phase, or binder material. In accordance with a particular embodiment, the chopped fiber bundles include inorganic fibers that are bound together in an organic binder, and may include materials commonly referred to as "chopped strand fibers".

Notably, chopped fiber bundle material is made of a plurality of individual fibers, such as on the order of at least about 200 individual fibers, and particularly between about 200 to about 6000 individual fibers per bundle. As such, the individual fibers of the chopped fiber bundles can be small, having an average diameter that is sub-micron. The fibers can include materials such as oxides, carbides, nitrides, borides, and a combination thereof. In particular instances, the fibers are a glass material, such as a silica-containing glass material.

The binder material holding the fibers together can be disposed between each of the fibers and may further surround the exterior surface of the bundle. In particular instances, the organic binder can be a thermoset polymer material, such as polyester, polyurethane, epoxy, phenolic resin, a vinyl, or a combination thereof. In accordance with one embodiment, the organic binder material consists essentially of polyurethane.

Generally, the fibers have a hardness that is less than the hardness of the abrasive grains. For example, the fibers can have a Mohs hardness that is less than about 7. In fact, the fibers may have a hardness that is less than about 6, such as less than about 5, and particularly between about 2 and about 5.

The chopped fiber bundles herein have particular dimensions that facilitate the formation of a bonded abrasive tool having particular mechanical characteristics and structure. In particular, the chopped fiber bundles generally have a length as measured along the longest dimension of the bundle that is not greater than about 5 mm. In particular, the chopped fiber bundles can have a length that is not great than about 4 mm, such as about 3 mm, and particularly within a range between about 1 mm and about 5 mm. More particularly, certain embodiments may utilize a length of chopped fiber bundles within a range between about 2 mm and about 4 mm.

The width of the chopped fiber bundles, that is in a direction perpendicular to the length, is generally less than the length. Typically, the width is not greater than about 3 mm. The width of certain chopped fiber bundles can be less, such as on the order of not greater than about 2 mm, not greater than about 1 mm, and particularly within a range between about 0.25 mm and about 2 mm.

In accordance with the foregoing, the chopped fiber bundles can have an aspect ratio as defined by the length and the width (l:w) that is at least about 2:1. In certain instances, the aspect ratio can be at least about 3:1, at least about 4:1, or even at least about 5:1. Still, the aspect ratio generally does not exceed 20:1 and can be within a range between about 2:1 to about 5:1.

Generally, the chopped fiber bundles are added to the mixture in a minor amount. In particular, it has been found that excessive amounts of the chopped fiber bundles may result in poor formation of the final bonded abrasive tool. As such, in accordance with an embodiment, the mixture generally includes not greater than about 5 vol % of chopped fiber bundles. In particular embodiments, the mixture includes between about 1 vol % and about 5 vol %, and more particularly between about 2 vol % and about 4 vol % chopped fiber bundles.

Referring again to the process of FIG. 1, after suitably forming the mixture, at step 101, the process continues by shearing the mixture at step 103. Notably, the shearing process facilitates the homogeneous dispersion of chopped fiber bundles throughout the mixture, while avoiding destruction or significant alteration of the chopped fiber bundles. Good dispersion of the chopped fiber bundles within the mixture facilitates forming a bonded abrasive tool having suitable mechanical characteristics and structure. As such, the shearing process can be an aggressive process conducted for a short duration at high shearing speeds. For example, the shearing process can be conducted for a duration of not greater than 60 seconds. In certain instances, the shearing process can be shorter, such as not greater than about 30 seconds or not greater than about 20 seconds. In particular embodiments, the shearing process is completed in about 5 seconds to about 20 seconds, and more particularly between about 10 seconds to about 15 seconds.

The speed at which the shearing process is conducted is generally on the order of at least about 30 revolutions per minute for the mixing members, such as between about 30 revolutions per minute and about 100 revolutions per minute. It will be appreciated that the mixing container can also be rotated, such as in a direction opposite of the mixing members. According to one embodiment, the mixing container can be rotated at a rate within a range between about 20 to about 40 revolutions per minute.

Referring again to FIG. 1, after shearing the mixture at step 103, the process continues by cold pressing the mixture to form a bonded abrasive body at step 105. In accordance with embodiments herein, the forming process is a cold pressing process conducted at a temperature of less than 30° C. Utilization of this forming process, in combination with the materials used herein, facilitates the formation of a bonded abrasive tool having particular features as will be described in more detail herein. In accordance with particular embodiments, the cold pressing process is conducted at a temperature within a range between about 10° C. and about 30° C., and more particularly within a range between about 20° C. and about 30° C.

Moreover, the pressing process can be conducted at a pressure of not greater than about 14 tons/in$^2$ to suitably form the bonded abrasive body having the attributes described herein. For example, the pressure can be on the order of about 13.5 tons/in$^2$, about 13 tons/in$^2$, or even about 12 tons/in$^2$. According to one particular embodiment, the maximum pressure used during cold pressing is within a range between about 10 tons/in$^2$ and about 14 tons/in$^2$.

Generally, the duration at which the maximum pressing pressure is held is a short duration to aid formation of the particular microstructure of the finished abrasive article. Accordingly, the maximum pressing pressure can be held for not greater than about 60 seconds. For example, certain embodiments hold the maximum pressure for not greater than about 40 seconds, not greater than about 30 seconds, or even about 20 seconds. Still, the duration at the maximum pressing pressure may be between about 20 seconds and about 35 seconds.

The atmosphere used during the pressing operation is generally that of an ambient atmosphere. However, in some instances, another atmosphere (e.g., a controlled atmosphere) can be utilized including a noble gas or inert gas.

After forming the mixture into a green body, the article can be cured. Curing is completed in a manner to facilitate formation of a particular microstructure in accordance with the embodiments herein. Notably, the curing process can be completed at a curing temperature of not greater than about 250° C., such as not greater than about 225° C., and particularly within a range between 150° C. and about 250° C. The curing process can be completed over a duration of at least about 6 hours. In other embodiments, the curing process may be longer, such that it lasts for a duration of at least about 10 hours, at least about 20 hours, at least about 30 hours, or even at least 40 hours. In certain embodiments, the curing process is completed between about 6 hours and about 48 hours. Atmospheric conditions during the curing process can be those of an ambient environment.

The combination of materials and processing facilitates the formation of a bonded abrasive article having a particular structure and mechanical characteristics. In accordance with an embodiment, the bonded abrasive body has a distinct type of porosity including large pores selectively disposed around the chopped fiber bundles. FIG. 2 includes an image of a portion of a bonded abrasive tool formed according to an embodiment. As illustrated, the bonded abrasive tool includes large pores 201, 202, and 203 (201-203) that are selectively disposed around the chopped fiber bundle 207. The large pores 201-203 are voids that can extend laterally (or circumferentially) around portions of the peripheral surfaces of the chopped fiber bundle 207 and may also extend longitudinally along portions of the length of the chopped fiber bundle 207.

As such, the large pores are generally proximate to the chopped fiber bundles and form a boundary between a portion of the external surface of the chopped fiber bundles and adjacent grains or organic bond material. Additionally, as illustrated in FIG. 2, the large pores 201-203 have irregular cross-sectional shapes and are not uniformly dispersed throughout the bond material, but are generally centered around the chopped fiber bundles.

The bonded abrasive tool further includes a certain content of small porosity which can be uniformly dispersed throughout the bond matrix material. As illustrated in FIG. 2, small pores 210, 211, and 212 (210-212) are uniformly dispersed throughout the bonded abrasive tool. The small pores 210-212 generally are spherically shaped, having circular cross-sectional shapes and are located within the bond matrix material or at an interface between the bond matrix material and the abrasive grains.

The bonded abrasive body can have a bimodal pore size distribution including a first mode made of the large pores, and a second mode made of the small pores. In particular, the discrepancy between the size of the pores is significant enough such that the distribution in pore sizes between the small pores and large pores it is not necessarily a single mode distribution.

The bonded abrasive body can have a pore size ratio describing the difference in average size of the large pores ($P_l$) as compared to the average size of the small pores ($P_s$). As such, the pore size ratio ($P_l$:$P_s$) of the bonded abrasive body can be at least about 2:1. In other instances, the pore size ratio can be at least about 3:1, such as at least about 5:1, or even at least about 10:1. Certain bonded abrasive tools have a pore sized ratio ($P_l$:$P_s$) within a range between about 2:1 and about 10:1.

In particular reference to the average size of the large pores, embodiments herein utilize large pores having an average size of at least about 1 mm, as measured in the longest dimension. In other instances, the large pores can have an average pore size that is at least about 2 mm, at least about 3 mm, and within a range between about 1 mm and about 10 mm.

In reference to the small pores of the bonded abrasive tool, typically the average pore size of the small pores is not greater than about 1 mm. For example, the small pores can have an average pore size that is not greater than about 0.5 mm, such as not greater than about 0.25 mm, or even not greater than about 0.1 mm. Small pores can have average sizes within a range between about 0.1 mm and about 1 mm.

The total volume of porosity within the bonded abrasive body is generally not greater than about 12 vol % of the total volume of the bonded abrasive body. In particular, the bonded abrasive bodies herein can be suitably dense, having a total porosity not greater than about 10 vol %, such as not greater than about 8 vol %, or even not greater than about 6 vol %. In certain circumstances, the bonded abrasive body has a porosity within a range between about 1 vol % and about 12 vol %, and more particularly between about 4 vol % and about 10 vol %.

Of the total amount of porosity within the bonded abrasive body, a significant portion, such as a majority, of the total volume of porosity can be contained within the large pores. For example, the large pores can comprise at least 50 vol % of the total porosity, such as at least about 60 vol %, at least about 70 vol %, or even at least about 75 vol %. In certain circumstances, at least about 75 vol % and not greater than about 98 vol % of the total volume of porosity is large pores.

Features herein provide bonded abrasive tools having particular mechanical characteristics. For example, the bonded abrasive tool can have a fracture toughness (Kc), otherwise a resistance to crack propagation, of at least about 750 J/mm$^2$. The fracture toughness of certain bonded abrasive bodies can be greater, such as at least about 800 J/mm$^2$, at least about 900 J/mm$^2$, or even at least about 1000 J/mm$^2$. Embodiments herein can have a fracture toughness within a range between about 750 J/mm$^2$ and about 1100 J/mm$^2$. The fracture toughness testing was completed on sample bars having the dimensions: length of 4 inches (10.2 cm), width of 0.5 inches (1.3 cm), and thickness of 0.5 inches (1.3 cm). A small notch of 0.125 inches deep (0.32 cm) is made on one side of the bar approximately at the midpoint of the length. The bar is positioned on an Instron tester and a force is applied on the opposite side of the sample bar, than the side containing the notch, and a force is applied on the bar to propagate a crack from the notch through to the side where force is being applied. The force that it takes to propagate the crack is recorded.

Furthermore, the bonded abrasive tools herein have particular material removal rates (MRR) coupled with particular G-ratios (MRR/WWR). The G-ratio is generally a measure of the material removal rate (MRR) versus the wear rate of the bonded abrasive body, otherwise a wheel wear rate (WRR). For example, bonded abrasive tool bodies herein can have material removal rates of at least about 14 in$^3$/min at a power of at least about 45 HP (Horsepower). In certain instances, the material removal rate can be greater, such as at least about 15 in$^3$/min, such as at least about 16 in$^3$/min, and particularly within a range between about 13 in$^3$/min and about 17 in$^3$/min at a power within a range between about 45 HP and about 51 HP.

Moreover, the bonded abrasive tools herein can have a G-ratio that is not greater than about 40 for a power within a range between about 45 HP and about 51 HP. In fact, the G-ratio of the tool can be not greater than about 38, not greater than about 35, not greater than about 30, or even not greater than about 28. According to one particular embodiment, the G-ratio is within a range between about 25 and about 40.

EXAMPLE 1

The following provides information on comparative tests conducted between a bonded abrasive tool formed according to a conventional process and a bonded abrasive tool formed according to the embodiments herein and having the features of embodiments herein. In particular, a first sample (Sample 1) was formed from a mixture containing 52% vol of zirconia-alumina abrasives, 44% vol of bond containing organic resin and active and inactive fillers. The mixture was sheared in a mixing bowl rotating at 30 rpm for a duration of 4 minutes. After shearing the mixture, the mixture was formed to a bonded abrasive tool through a warm pressing process conducted at a temperature of 75° C. for a duration of 6 minutes under a pressure of 8 tons/in$^2$. After forming the sample, a curing process was completed in an ambient atmosphere at a temperature of approximately 200° C. for a duration of 24 hours.

A cross-sectional image of a portion of Sample 1 is illustrated in FIG. 3. Notably, the porosity within the body is small, spherical-shaped pores (circular in cross-section) 301, 302, and 303 that are uniformly distributed throughout the bond matrix material. A majority of the small pores may be located at or proximate to the boundaries between the abrasive grains and the bond matrix material. Generally, the pores have an average pore size that is less than about 1 mm.

A second sample was formed according to the processes herein. In particular, the sample (Sample 2) was formed from a mixture including 50 vol % abrasive grains, wherein the abrasive grains had an average size between 2 to 5 mm, combined with an organic bond matrix material comprising phenolic resin as well as active and inactive fillers in an amount of approximately 39 vol %. The mixture further included approximately 5 vol % of liquid pore-forming material. After forming this mixture, the chopped fiber bundles were added to the mixture in an amount of approximately 3 vol %. The mixture was then sheared for 10 to 15 second, wherein the mixing container was operated in a first rotational direction (e.g., clockwise) at a speed of about 20-40 revolutions per minute, and the mixing members within the container were operated in an opposite direction at approximately 50 revolutions per minute. The chopped fiber bundles had an average length of approximately 3 mm and an average diameter of approximately 1 mm. The chopped fiber bundles are commonly available as 183 Cratec™ (Trademark) product from Owens Corning corporation. Sample 2 was formed through a cold pressing process conducted at approximately 20° C. under a pressure of approximately 12 tons/in$^2$ for a duration of 30 seconds. After forming the sample, a curing process was completed in an ambient atmosphere at a temperature of approximately 200° C. for a duration of 24 hours.

A grinding test was performed on each of the samples to determine comparative performance characteristics between the two tools. The grinding testing conditions included grinding a metal workpiece made of A36 steel, having a 0.5 inch thickness, that was rotating at 15 rpm, while applying the formed abrasive samples to the rotating workpiece under a downforce of 45-50 HP applied to the abrasive tools. During grinding, the abrasive samples were rotated at a speed of 3600 rpm for 1 hour.

Referring to FIG. 4, a graph is provided of wheel wear rate versus material removal rate for each of the two samples. As illustrated, the graph includes a first plot 401 that corresponds to the grinding performance of the conventionally formed sample, Sample 1. Plot 402 corresponds to the grinding performance of Sample 2, formed according to embodiments herein. As illustrated in FIG. 4, Sample 2 demonstrated greater material removal rates. It is theorized that the improved material removal rate may be attributed in part to the nature of the porosity within the bonded abrasive tool. Sample 2 demonstrates a lower G-ratio in comparison to that of the conventionally formed sample, however, the G-ratio is balanced by the improvement in material removal rate and the life of the abrasive tool is not significantly compromised.

Further evidence of the improved material removal rate of Sample 2 as compared to Sample 1 is provided in FIGS. 5 and 6. FIG. 5 provides a picture of metal chips removed during the grinding process using Sample 1. FIG. 6 includes a picture of metal chips removed during the grinding process using Sample 2. Notably, the pictures were taken at the same magnification and as illustrated in a comparison of FIGS. 5 and 6, the metal chips removed during the grinding process of Sample 2 are larger. Accordingly, Sample 2 is generally capable of removing a greater amount of the workpiece than Sample 1, and thus has an improved MRR, as indicated by the data.

EXAMPLE 2

Sample 1 and Sample 2 were further tested to compare fracture toughness between the two bonded abrasive bodies. The fracture toughness testing procedures included are the same procedures as described herein. Notably, the fracture toughness procedure were completed on bars, that were indented with a notch and then a tensile force was applied until a crack propagated from the notch through the sample.

TABLE 1

| Fracture Toughness (J/mm2) | | |
|---|---|---|
| | Sample 1 | Sample 2 |
| | 584 | 1277 |
| | 640 | 961 |
| | 664 | 661 |
| | 674 | 871 |
| | 649 | 1184 |
| | 635 | 1054 |
| | 541 | 899 |
| | 362 | 977 |
| | 423 | 1169 |
| | 678 | 870 |
| | 628 | |
| | 530 | |
| | 599 | |
| | 572 | |
| Average | 584 | 992 |
| St. Dev. | 94 | 183 |

The results of the fracture toughness data for Samples 1 and 2 are provided in Table 1 above. Additionally, FIG. 7 is a plot of the data of Table 1. As indicated by the data, Sample 2 demonstrates significantly greater fracture toughness as compared to the standard sample (Sample 1). Accordingly, Sample 2 has greater crack propagation resistance and likely improved breakage resistance as well as operable lifetime over Sample 1.

The foregoing has described a bonded abrasive tool that represents a departure from the state of the art. In particular, the bonded abrasive tools of the embodiments herein include a combination of features including particular types of bond matrix material, utilization of chopped fiber bundles having particular dimensions and materials, and certain processing techniques that facilitate the formation of a bonded abrasive tool having particular types of porosity. Without wishing to be tied to a particular theory, it has been theorized that the provision of certain type of chopped fiber bundles, combined with the particular type of bond material and forming procedures results in a localized "spring-back" reaction during processing such that a distinct phase of large pores are formed around the chopped fiber bundles at the interface between the exterior surface of the chopped fiber bundles and bond material. Such pores may facilitate improved swarf removal and bundles of fibers provide greater toughness by slowing crack propagation. Overall, the bonded abrasive bodies of the embodiments include a combination of features that facilitate an improvement in grinding performance, toughness, and operable lifetime when compared to conventional bonded abrasive tools.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is

1. A bonded abrasive tool comprising:

a bonded abrasive body including:

a bond matrix material comprising an organic bond material;

abrasive grains contained within the bond matrix material;

not greater than about 5 vol % chopped fiber bundles within the bond matrix material; and porosity within the bonded abrasive body, wherein a majority of the porosity comprises pores surrounding the chopped fiber bundles.

2. The bonded abrasive tool of claim 1, wherein the organic bond material comprises a polymer material selected from the group consisting of thermoplastic resins, thermosetting resins, rubbers, and a combination thereof.

3. The bonded abrasive tool of claim 2, wherein the organic bond material is selected from the group of materials consisting of epoxies, polyesters, phenolics, cyanate esters, and a combination thereof.

4. The bonded abrasive tool of claim 3, wherein the organic bond material consists essentially of phenolic resin.

5. The bonded abrasive tool of claim 1, wherein chopped fiber bundles comprise at least about 200 fibers bonded together with an organic binder.

6. The bonded abrasive tool of claim 5 wherein chopped fiber bundles comprise an amount of fibers within a range between about 200 fibers and about 6000 fibers per bundle.

7. The bonded abrasive tool of claim 5, wherein the organic binder comprises a thermoset polymer material.

8. The bonded abrasive tool of claim 5 wherein the organic binder covers a majority of the external surface of each of the chopped fiber bundles.

9. The bonded abrasive tool of claim 1, wherein the chopped fiber bundles comprise fibers comprising a material selected from the group of materials consisting of oxides, carbides, nitrides, borides, and a combination thereof.

10. The bonded abrasive tool of claim 9, wherein the fibers comprise a glass material.

11. The bonded abrasive tool of claim 1, wherein the chopped fiber bundles comprise a length of not greater than about 5 mm.

12. The bonded abrasive tool of claim 1, wherein the chopped fiber bundles comprise a length (l), a width (w), and an aspect ratio (l:w) defined by the length and the width of at least about 2:1.

13. The bonded abrasive tool of claim 12, wherein the aspect ratio is within a range between about 2:1 and about 5:1.

14. The bonded abrasive tool of claim 1, wherein the bonded abrasive body comprises not greater than about 12 vol % porosity.

* * * * *

UNITED STATES PATENT AND TRADEMARK OFFICE

CERTIFICATE OF CORRECTION

PATENT NO. : 8,252,075 B2
APPLICATION NO. : 12/645275
DATED : August 28, 2012
INVENTOR(S) : Konstantin S. Zuyev et al.

It is certified that error appears in the above-identified patent and that said Letters Patent is hereby corrected as shown below:

On the Title Page, Item 73, please delete "Saint-Goabain Abrasifs, Conglans-Sainte-Honorine" and insert therefor --Saint-Gobain Abrasifs, Conflans-Sainte-Honorine--.

Signed and Sealed this
Eleventh Day of December, 2012

David J. Kappos

David J. Kappos
*Director of the United States Patent and Trademark Office*